United States Patent [19]

Chien et al.

[11] Patent Number: 4,654,614

[45] Date of Patent: Mar. 31, 1987

[54] CURRENT LIMITING SOLENOID OPERATED CIRCUIT BREAKER

[75] Inventors: Yun-Ko N. Chien, Murrysville; John A. Wafer, Brighton Township, Beaver County; Walter V. Bratkowski, McKeesport, all of Pa.

[73] Assignee: Westinghouse Electric Corp., Pittsburgh, Pa.

[21] Appl. No.: 707,616

[22] Filed: Mar. 4, 1985

[51] Int. Cl.[4] ..... H01H 9/30

[52] U.S. Cl. ..... 335/201; 200/147 R

[58] Field of Search ..... 335/14, 20, 201; 200/147 R

[56] References Cited

U.S. PATENT DOCUMENTS

| | | | |
|---|---|---|---|
| 2,687,462 | 8/1954 | Cellerini | 200/147 R |
| 3,155,801 | 11/1964 | Pokorny | 200/147 R |
| 4,001,743 | 1/1977 | Arnhold | 335/201 |
| 4,223,288 | 9/1980 | Stiner | 335/20 |
| 4,451,718 | 5/1984 | Yamagata et al. | 200/147 R |

*Primary Examiner*—Michael L. Gellner
*Assistant Examiner*—Brian W. Brown
*Attorney, Agent, or Firm*—L. P. Johns

[57] ABSTRACT

A current limiting solenoid operated circuit breaker characterized by an arc quenching chamber having spaced arc guide rails along opposite sides of the chamber, stationary and movable contacts in an arcing zone adjacent to the chamber and electrically connected to corresponding guide rails, and a conductor around the arcing zone to generate a transverse magnetic field through an arc to drive the arc from the contacts and along the guide rails to the arc quenching chamber.

2 Claims, 10 Drawing Figures

CURRENT LIMITING SOLENOID OPERATED CIRCUIT BREAKER

CROSS REFERENCE TO RELATED APPLICATION

This application is related to the copending application Ser. No. 707,632, filed Mar. 4, 1985, entitled "Remotely Controlled Solenoid Operating Circuit Breaker", of J. A. Wafer and W. V. Bratkowski assigned to the present assignee.

BACKGROUND OF THE INVENTION

1. Field of the Invention

This invention relates to current limiting circuit breakers and, more particularly, to circuit breakers having a one turn in-line magnetic blowout coil to improve the performance of contact erosion, current limiting, and interruption ability.

2. Description of the Prior Art

Current limiting circuit breakers have been used successfully in recent years to limit these fault currents. They can reduce to tolerable levels both the peak fault currents ($I_p$) and thermal energy ($I^2t$) that reach downstream equipment. Mechanical and magnetic forces that can destroy equipment are proportional to the square of the peak currents $(I_p)^2$, and thermal damage is proportional to the energy let-through ($I^2t$). Current limiting devices not only perform the function of a circuit breaker and current limiting fuse, but are also resettable and reusable. These devices can also be effectively applied to motor control as well as power distribution systems.

Notwithstanding the foregoing, two major factors control how well current limiting occurs; namely, how quickly the contacts separate after initiation of a fault current, and how quickly the impedance of the air arc develops, more particularly, as the contacts separate and arc is drawn between them. The next stage in the current limiting process is to develop a high arc voltage. This is accomplished by stretching and blowing an arc off of the contacts into a set of deion plates by self-induced electromagnetic forces. When the arc hits the plates it is lengthened, split up, and cooled rapidly, which generates a high resistance arc. The arc is a circuit element and a nonlinear resistor with the arc voltage in phase with the arc current. The success of this approach requires a very high contact opening speed. The faster the contacts separate after initiation of the fault current, the shorter the dwell time of the arc acting on the contacts. Thus, the volume of melting and volatilization of the contact material is minimized.

SUMMARY OF THE INVENTION

It has been found in accordance with this invention that a current limiting circuit breaker in an electric circuit may be provided which comprises an electrically insulated housing including line and load terminals, and an arc quenching chamber within the housing and having a first arc guide rail along one side of the chamber and a second arc guide rail along the other side of the chamber, a circuit breaker structure within the housing and having stationary and movable contacts in an arcing zone in front of the chamber, the stationary and movable contacts being electrically connected to the first and second guide rails, respectively, means for actuating the movable contact between open and closed circuit positions and including current limiting electromagnetic means responsive to an overcurrent circuit condition, solenoid means for opening the movable contact between open and closed positions independent of the circuit breaker structure, and a conductor connected in the circuit through the circuit breaker and including at least one loop portion second and on one side of the arcing some so as to generate a magnetic field transverse to the opening contacts and to the arc column on the guide rails and thence drive the arc into the arc quenching chamber.

The circuit breaker of this invention has the dual advantage of quickly separating the contacts after initiation of a fault current and rapidly moving the resulting arc from the contacts to an arc quenching chamber.

DESCRIPTION OF THE PREFERRED EMBODIMENTS

Figure 1:
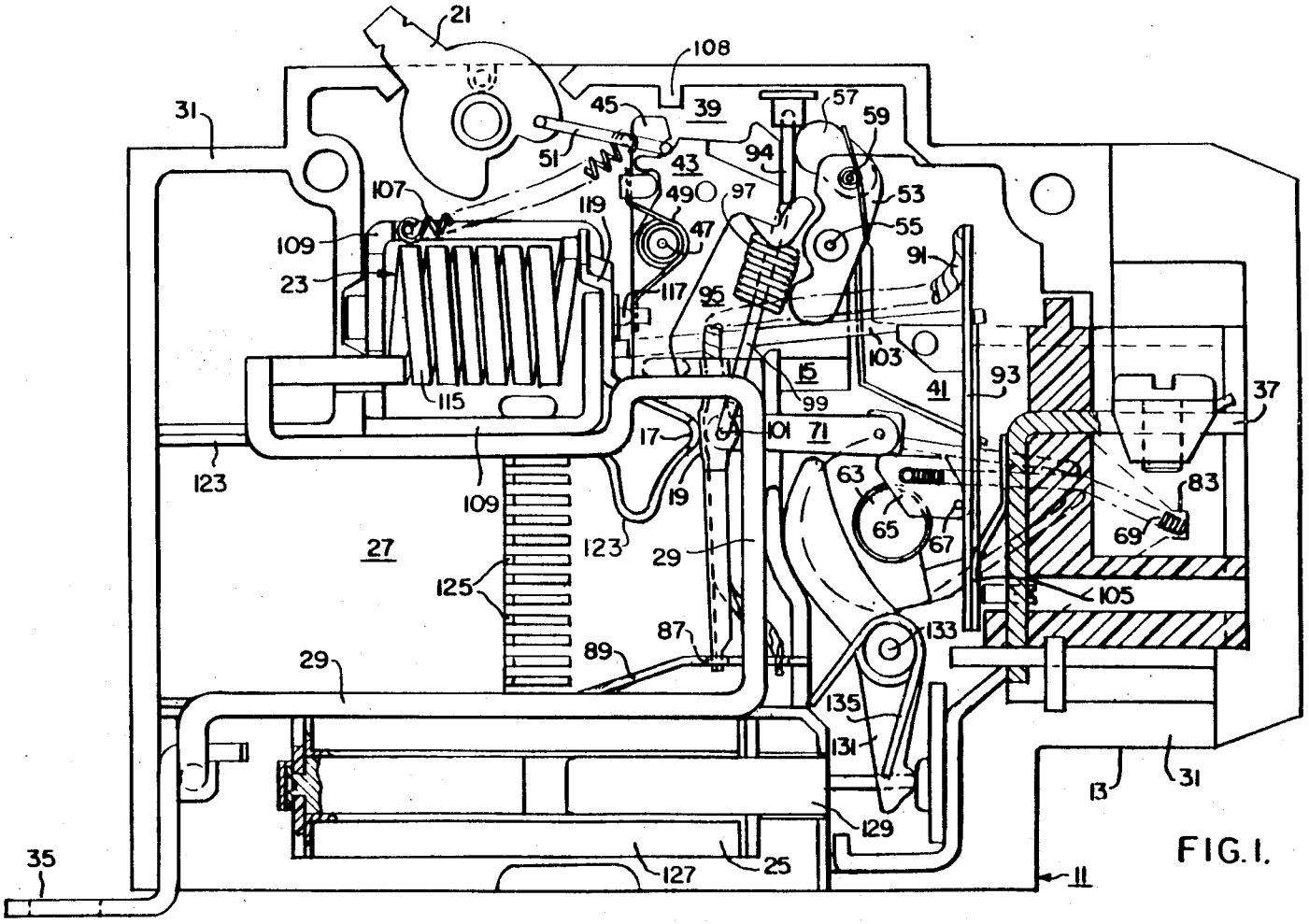
FIG. 1 is a vertical sectional view through a circuit breaker, taken on the line 1—1 of FIG. 2, showing contacts in a closed position.

In FIG. 1, a circuit breaker is generally indicated at 11 and it comprises a housing 13 and circuit breaker structure 15 including stationary contact 17 and movable contact or contact member 19, means for actuating the movable contact including a handle 21, a current limiting electromagnetic mechanism 23, a solenoid structure 25, and a bimetal strip 93. The circuit breaker 11 also comprises an arc quenching device 27 and a conductor or blowout coil 29.

Figure 2:
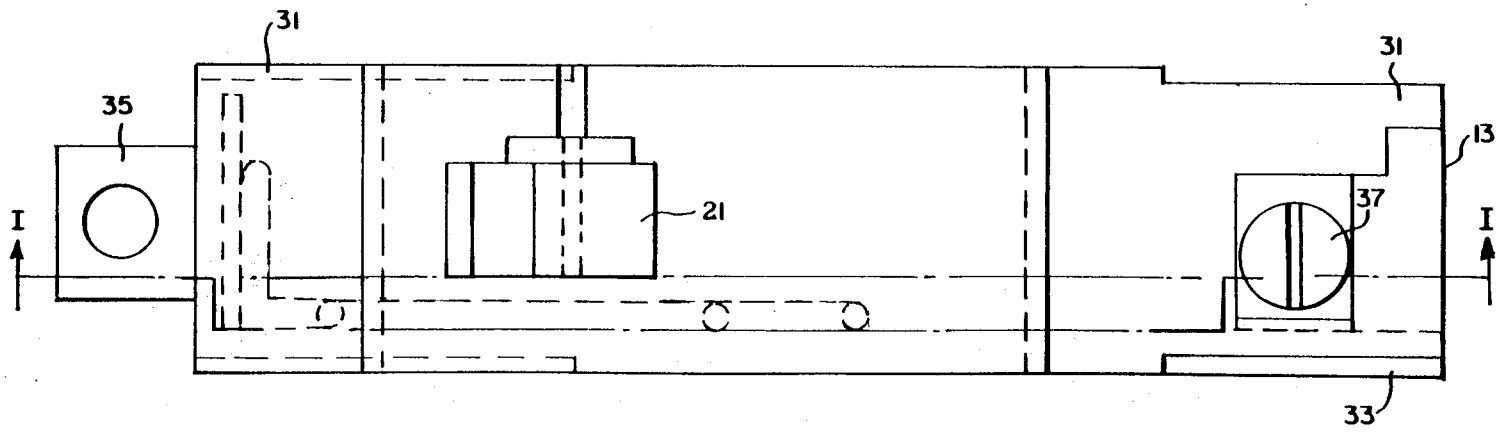
FIG. 2 is a plan view of the circuit breaker of FIG. 1.

The housing 13 is comprised of a body 31 and a detachable cover 33 (FIG. 2), both of which are comprised of an electrically insulating material such as an epoxy resin or thermoplastic material. A line terminal 35 is mounted on and extends from the housing body 13 (as shown at the left of FIG. 1). A load terminal 37 extends from the right end thereof.

The circuit breaker structure 15 is mounted within the chamber of the housing 13 and comprises an unlatching mechanism 39 and a bistable toggle mechanism 41. The unlatching mechanism 39 includes an operating or kicking lever 43 and a releasing lever 45, both of which are pivotally mounted on a pivot pin 47. The releasing lever 45 fits within a recess of the kicking lever 43 where it is retained in place by a bias spring 49

(FIG. 1). A wire bail 51 extends from the handle 21 to the upper end of the releasing lever 45.

The circuit breaker structure 15 also comprises an assist lever 53 pivoted at 55, which lever includes a pawl 57 which is pivoted at 59 on the upper end of the lever 53. The assist lever 53 cooperates with the unlatching mechanism 39 for preventing closing of the contacts 17, 19, when the handle 21 is in the off or trip position (FIG. 3) which is described more fully hereinbelow.

Figure 4:
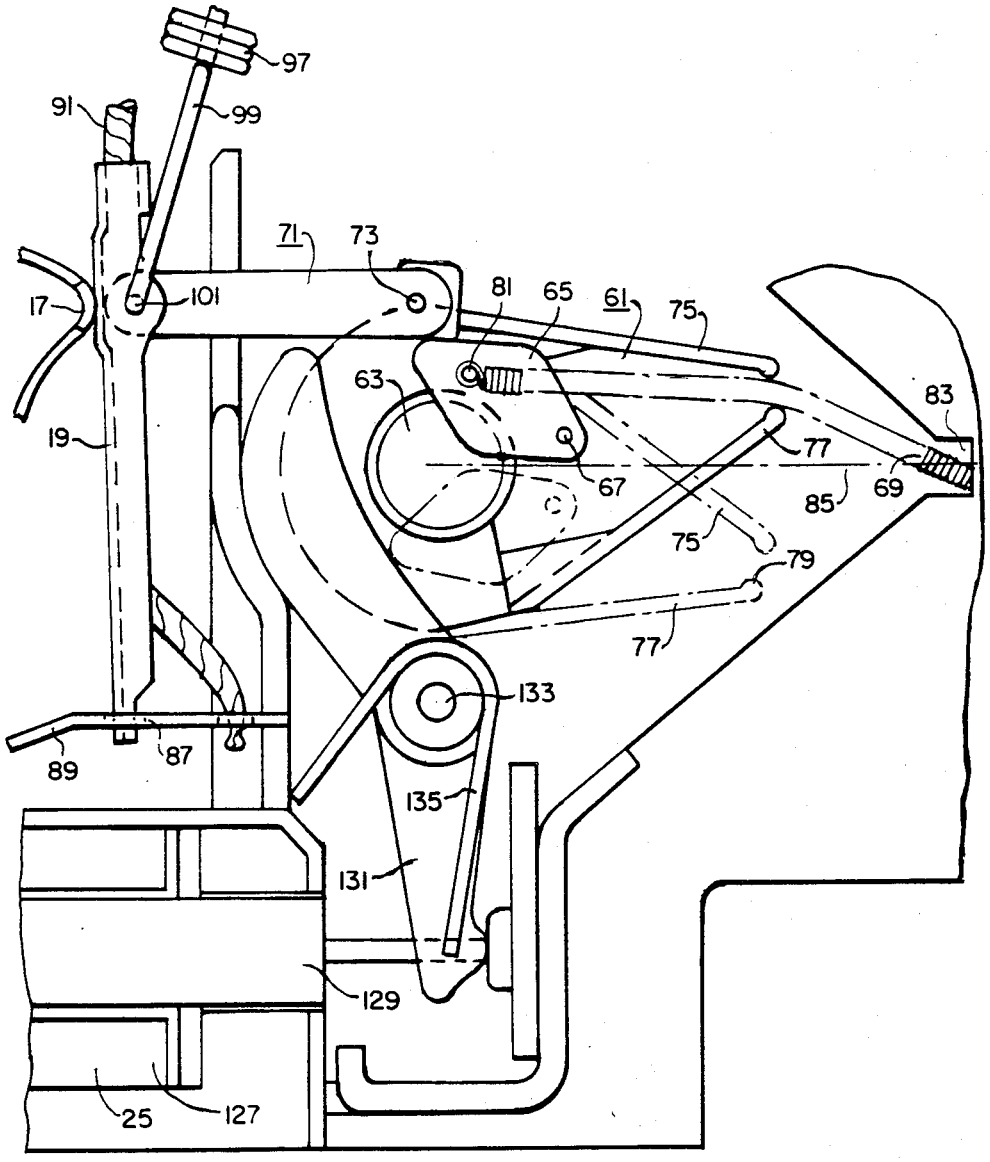
FIG. 4 is an enlarged fragmentary view of the bistable toggle mechanism in the contact-closed position.
Figure 5:
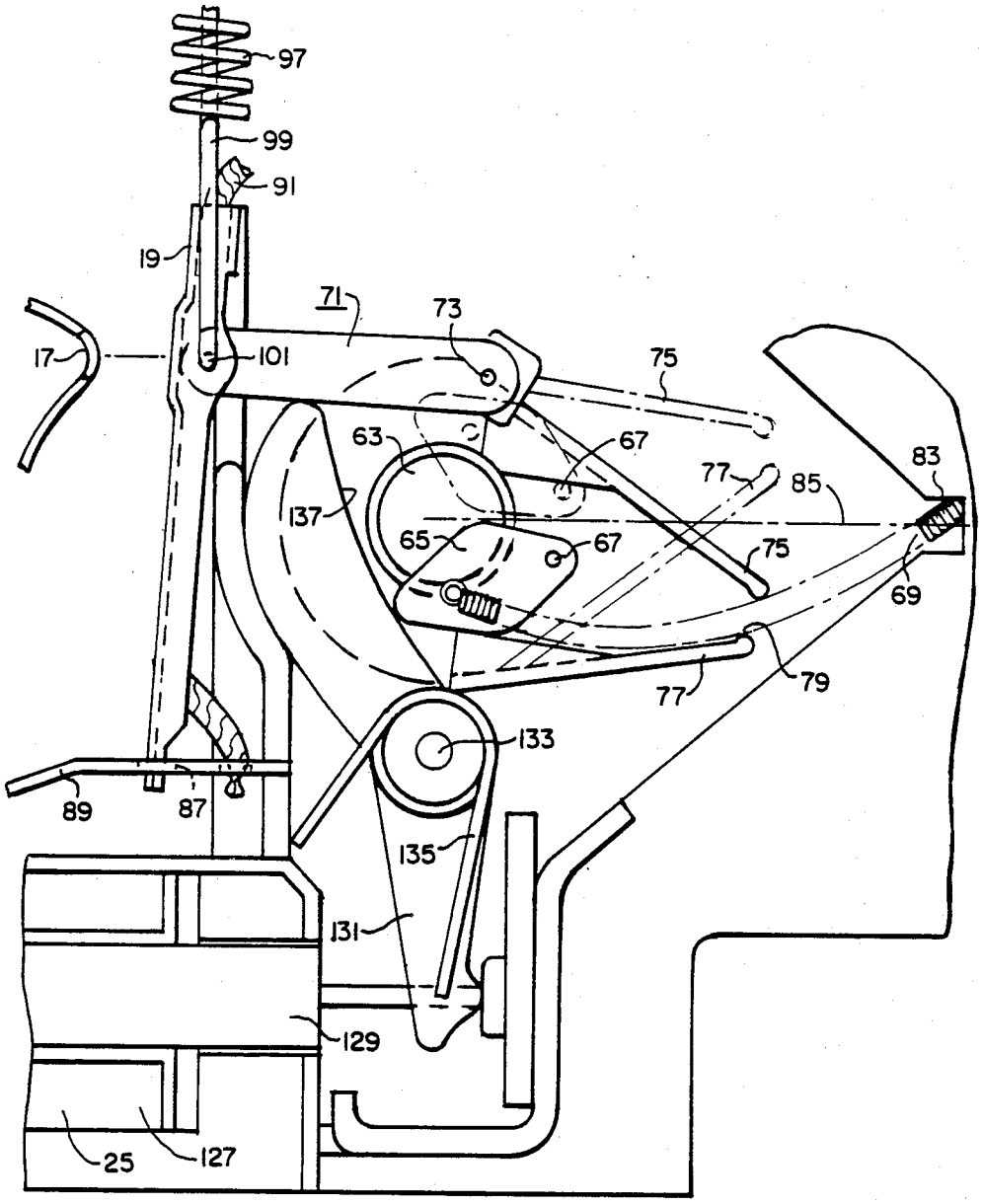
FIG. 5 is a view similar to FIG. 4 with the contacts open.

The bistable toggle mechanism 41 (FIG. 4) includes a lever 61 pivoted at pin 63, a spring-biased pawl of flipper 65 pivoted at 67 on the lever, and a toggle spring 69. A connecting link 71, pivoted at 73, extends between movable contact 19 and the lever 61. The lever 61, being a pear-shaped body, includes flanges 75, 77 which extend upwardly from the surface of the lever and form opening means or notch 79. The toggle spring 69 is secured at one end to a pin 81 on the flipper 65 and extends therefrom through the notch 79 to a location 83 on the housing body 31 below the load terminal 37 (FIG. 1). When the contact 19 is disposed in the contact-closed position, the lever 61 is disposed with the notch 79 located above an imaginary line 85 extending between the pin 63 and the location 83, whereby the spring 69 extends as shown and causes the flipper 65 to be located in a position (FIG. 4) adjacent the flange 75. On the other hand, when the contacts are open, the lever 61 is in the position (FIG. 5) with the notch 79 disposed below the line 85, whereby the spring 69 pulls the flipper 65 to the position adjacent the flange 77 (FIG. 5).

Figure 3:
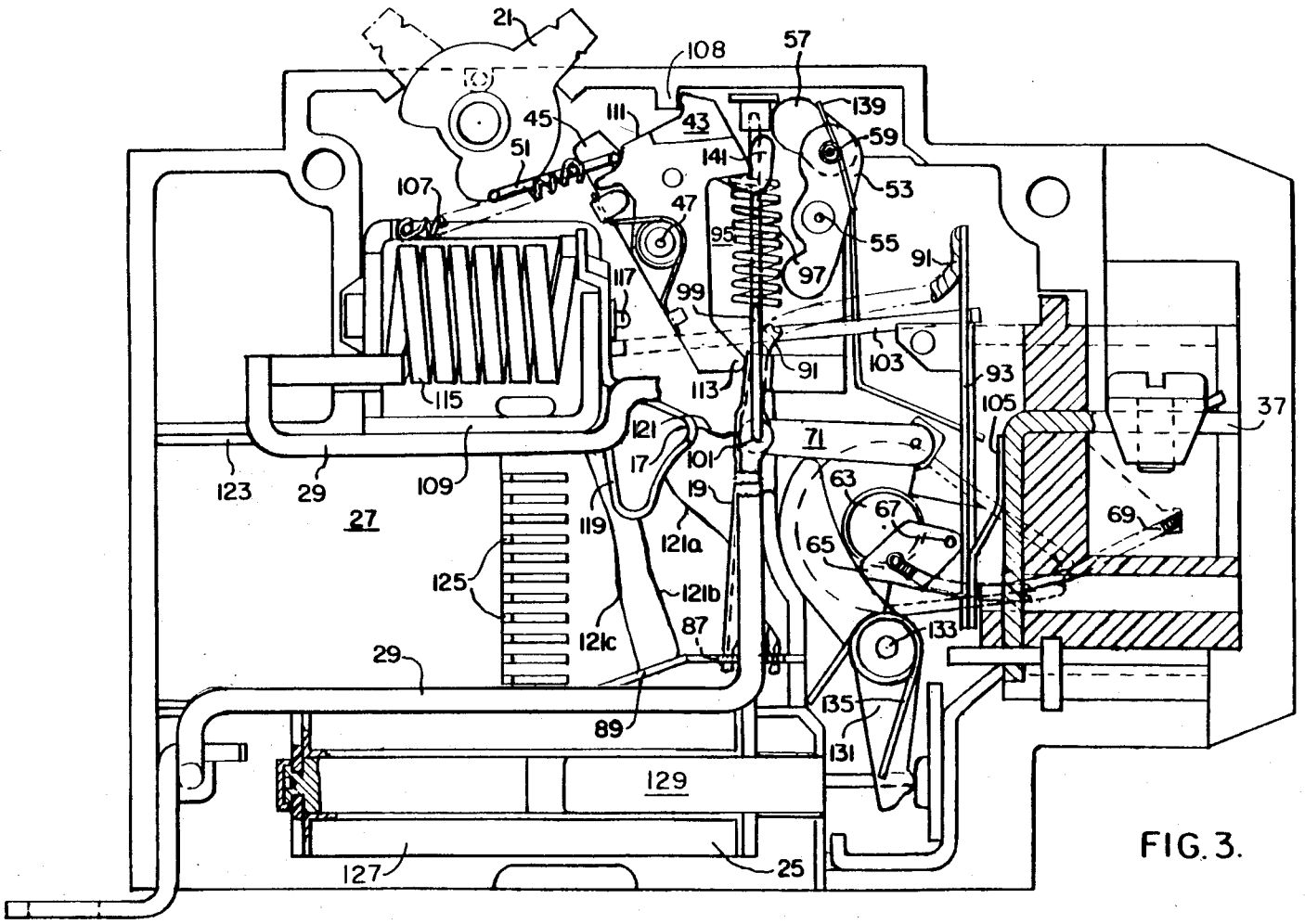
FIG. 3 is a vertical sectional view showing the contacts in the open position.

The movable contact 19 is an elongated member pivoted in a hold 87 in an arc guide rail 89. The upper end of the contact 19 is connected to a shunt 81 which is connected to the upper end of a bimetal strip 93 (FIGS. 1, 3). The movable contact 19 is influenced by a spring assembly 95 which includes a coil spring 97 and a spring guide bail 99 (FIG. 1). The lower end of the bail 99 is pivotally connected at 101 where the link 71 is similarly pivoted. The upper end of the guide bail 99 is disposed between the kicking lever 43 and the pawl 57 of the assist lever 53. In operation, the spring assembly 95 functions as a toggle spring mechanism for moving the contact 19 between the closed position (FIG. 1) and the open position (FIG. 3), whereby the pivot 101 moves from one side of a line extending from the hole 87 to the upper end of the spring 97.

The contacts 17, 19 are open and closed by three conventional means including the manually operated handle 21, the bimetal strip 93, and the current limiting electromagnetic device 23. The bimetal strip 93 is operable through a line 103 which extends from the strip to the side of the release lever 45, whereby an overcurrent passing through the bimetal strip causes it to move clockwise about its lower end where it is connected to a conductor 105, thereby moving the link 103 to the right to actuate the release lever 45.

Rotation of the release lever 40 rotates the kicking lever 43 counterclockwise, whereby the lower end portion 113 of the lever 43 kicks the movable contact 19 away from the stationary contact 17 (FIG. 3). Simultaneously, the release lever 45 rotates to a retracted position (FIG. 3) to unlatch the bail 91 from a latched position (FIG. 1) between the levers 43 and 45. As the movable contact 19 moves, the spring assembly 95 moves overcenter to release the coil spring 95 that, in turn, rotates the kicking lever 43 counterclockwise to retain the movable contact in open position (FIG. 3). At the same time the unlatched bail 51 rides over a top surface 111 of the kicking lever 43 until the lever hits a stop 108 protruding from the housing. The spring 107 rotates the handle 21 to the "off" position after the contacts are open and resets the wire bail 51 in a notch (FIG. 3) between the levers. In this manner the lever 43 moves quickly to open the contacts without being delayed by overcoming inertia of rotating the handle 21 from "on" to "off"; however, it is understood that the overall action is an fast that it appears to be simultaneous.

The current limiting electromagnetic device 23 comprises a coil 115 and an armature 117 supported within the frame 109 which in turn is mounted on the housing body 13. If release operation is a result of a short circuit, the armature 117 strikes the release lever 45 to actuate the kicking lever 43, thereby moving the spring assembly 95 through the toggle operation to move the movable contact 19 to the position shown in FIG. 3.

The circuit through the circuit breaker 11 (FIG. 1) extends from the line terminal 35 through the conductor or blowout coil 29, the coil 115 and conductor 119 including the stationary contact portion 17, the movable contact 19, the shunt 91, the bimetal strip 93, and the conductor 105 to the load terminal 37.

During separation of the contacts 17, 19, any arc 121 (FIG. 3) that develops travels downwardly from the point of origin into the arc quenching device 27, such as indicated by arc positions 121*a*, 121*b*, and 121*c* with the arc extending to greater length between the lower portion of the conductor 119 and the lower portion of the contact member 19. From there, the lower arc guide rail 89 and upper guide rail 123, with which the conductor 119 is connected, guide the arc to arc extinguishing plates 125 where the arc is extinguished.

To facilitate movement of the arc from the point of origin at the contacts 17, 19, the conductor or blowout coil 29 is disposed substantially as shown around the areas of origin and travel of the arc 121 to provide a generated transverse magnetic field in the arcing area. The conductor includes portions 29*a*, 29*b*, 29*c* which form a loop around the arcing area, avoiding the metal conductor 109. Thus, the single loop in-line magnetic blowout coil 29 generates a transverse magnetic field ($B_T$) in the arcing area. The magnitude of the magnetic field is proportional to the let-through current of the breaker.

The electromagnetic force, a product of current density and magnetic field applied on the arc column and perpendicular thereto, drives, moves, or blows the arc out of the contact area onto the rails 89, 123, as soon as possible after the contacts separate. The circuit breaker 11 is provided with means for interrupting the current in addition to the manual handle 21, the current limiting electromagnetic device 23, and the bimetal strip 93. The additional means includes the solenoid structure 25 and associated parts thereof including the bistable mechanism 41 to enable energy management and remote control operation.

Figure 6:
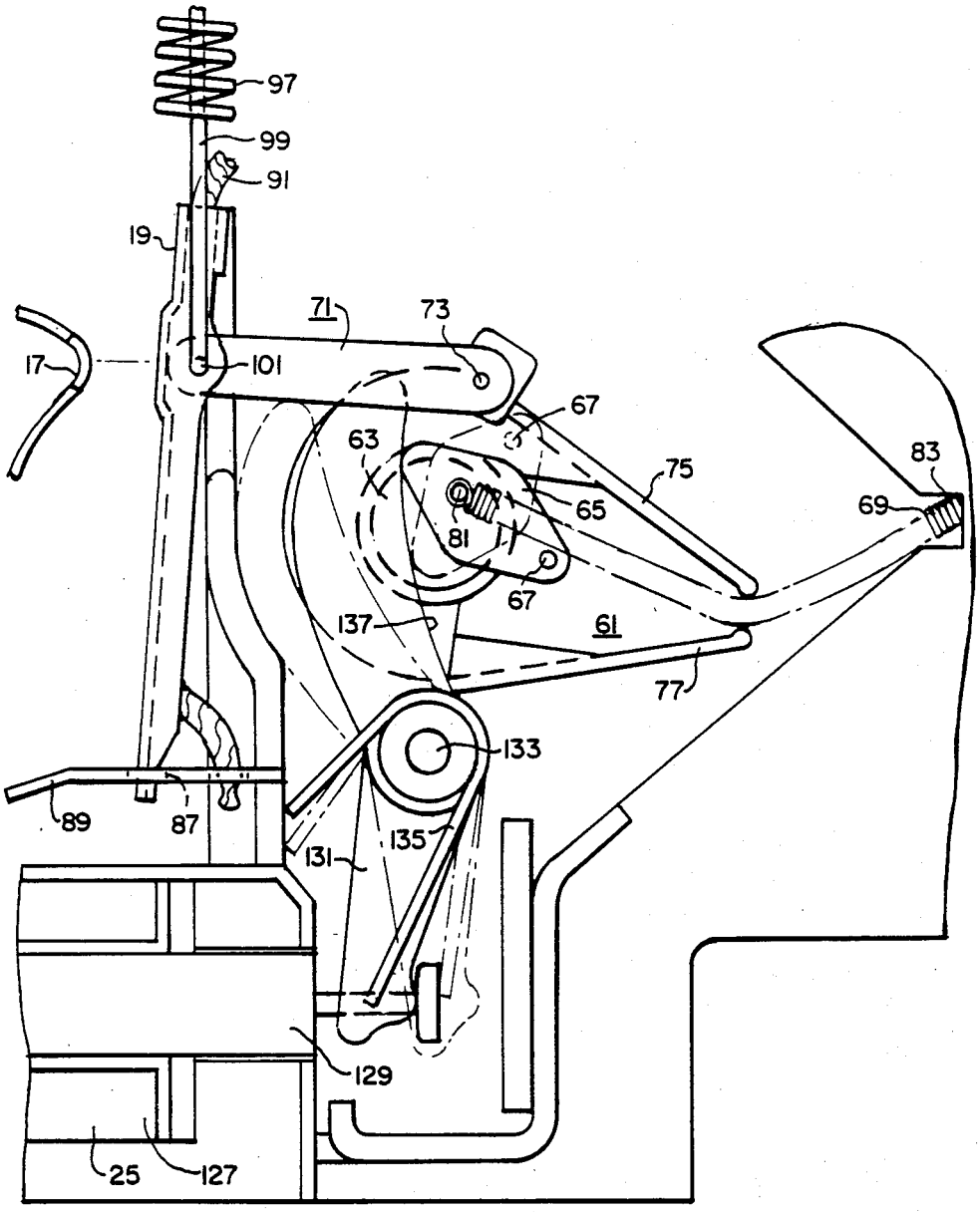
FIG. 6 is a fragmental view of the bistable toggle mechanism with the actuation lever in the actuated position and the mechanism in the contact-open position.

The solenoid structure 25, which is electrically controlled from a remote location, comprises a coil 127 and plunger 129. The plunger extends through an opening in the lower portion of a lever or propeller 131. When the solenoid structure 25 is actuated by a pulse of current, the plunger 129 retracts into the coil, moving the propeller 131 about a pivot 133 from the broken line position (FIG. 6) to the solid line position 131. As the propeller moves to the later position, it strikes the flipper 65 and rotates the lever 61 clockwise around the pivot 63 to the broken line position 77 (FIGS. 4, 5). By that movement of the lever 61, the link 71 pulls the movable contact 19 away from the stationary contact 17, thereby opening the circuit. Thereafter, the plunger returns to the extended position (FIG. 4) under the influence of a wire spring 135 and returns the propeller to the retracted, broken line position (FIG. 6). As the lever 61 rotates counterclockwise, the notch 79 moves below the line 85 and relocates the position of the spring 69 with respect to the flipper (FIGS. 4, 5). Accordingly, as the propeller retracts, the flipper 65 moves counterclockwise adjacent an arcuate surface 137 of the propeller to the broken line position 65 (FIG. 6) in response to the force of the spring 69.

Figure 7:
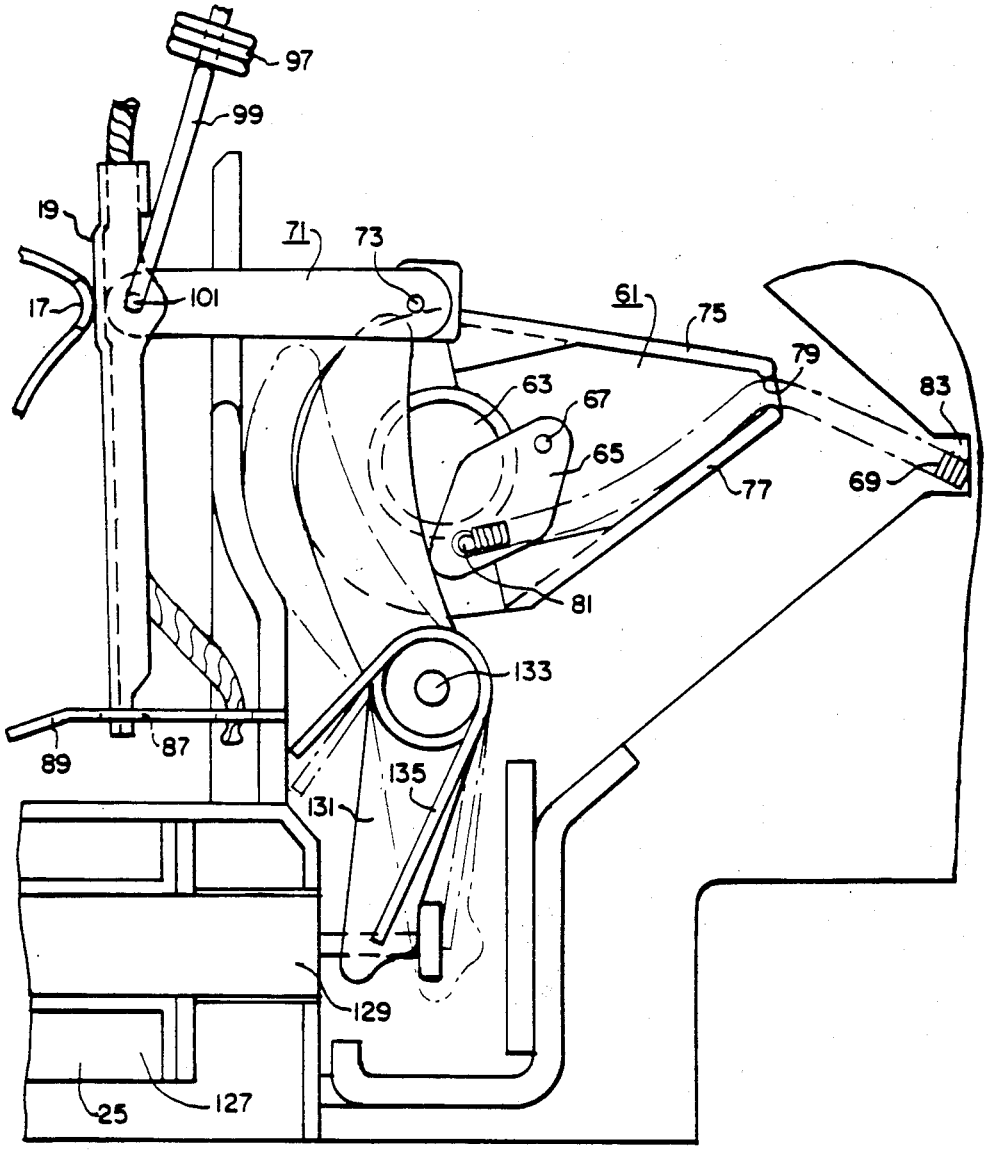
FIG. 7 is a fragmentary view of the bistable toggle mechanism with the lever in the actuated position and the mechanism in the contact-closed position.

Subsequently, when the solenoid structure 25 is actuated by a pulse of current to close the contacts, the propeller 131 moves against the lower end of the flipper 65 (FIG. 7) to rotate the lever 61 counterclockwise in response to the pressure on the pivot 67 of the flipper, thereby moving the movable contact 19 against the stationary contact 17 in response to a movement on the link 71. As the lever 61 rotates counterclockwise, the notch 79 moves above the line 85 (FIG. 5), whereupon the spring 69 rotates the flipper 65 clockwise to the upper position (FIG. 4) as the propeller retracts. Accordingly, the bistable toggle mechanism 41 is returned to its original condition with the contacts closed.

Operation of the bistable toggle mechanism for closing the contacts is dependent upon the position of the manual handle 21. When the handle is in the "on" position (FIG. 1), remote control of the circuit breaker through the solenoid structure 25 and the bistable toggle mechanism is feasible. But when the manual handle is in the "off" position (FIG. 3), the contacts are open and remote control for closing the contacts is not feasible.

More particularly, with the manual handle in the tripped or "off" position, an attempt to close the contacts by actuating the propeller 131 against the flipper 65 (FIG. 6) is defeated by pressure against the movable contact 19 by the lower end portion 113 of the operating lever 43 (FIG. 3). In that position, the pawl 57 is disposed against the upper end of the lever 43 to prevent its clockwise rotation about the pivot 47 in response to any attempt through the link 71 to close the contacts. The pawl 57 is rotated to that position under the force of a wire spring 139 when the handle 21 is disposed in the "off" position.

Subsequently, when the handle 21 is moved to the "on" position, the portion 141 of the lever 43 compresses the spring 97 and slides under the surface of the pawl 57, causing it to move against the spring 139 to return to the upper position as shown in FIG. 1, whereby the lower end portion 113 of the lever is retracted from the upper portion of the movable contact 19. Thus the remote control operation of the circuit breaker 11 through the solenoid structure 25 is again feasible.

Figure 8:
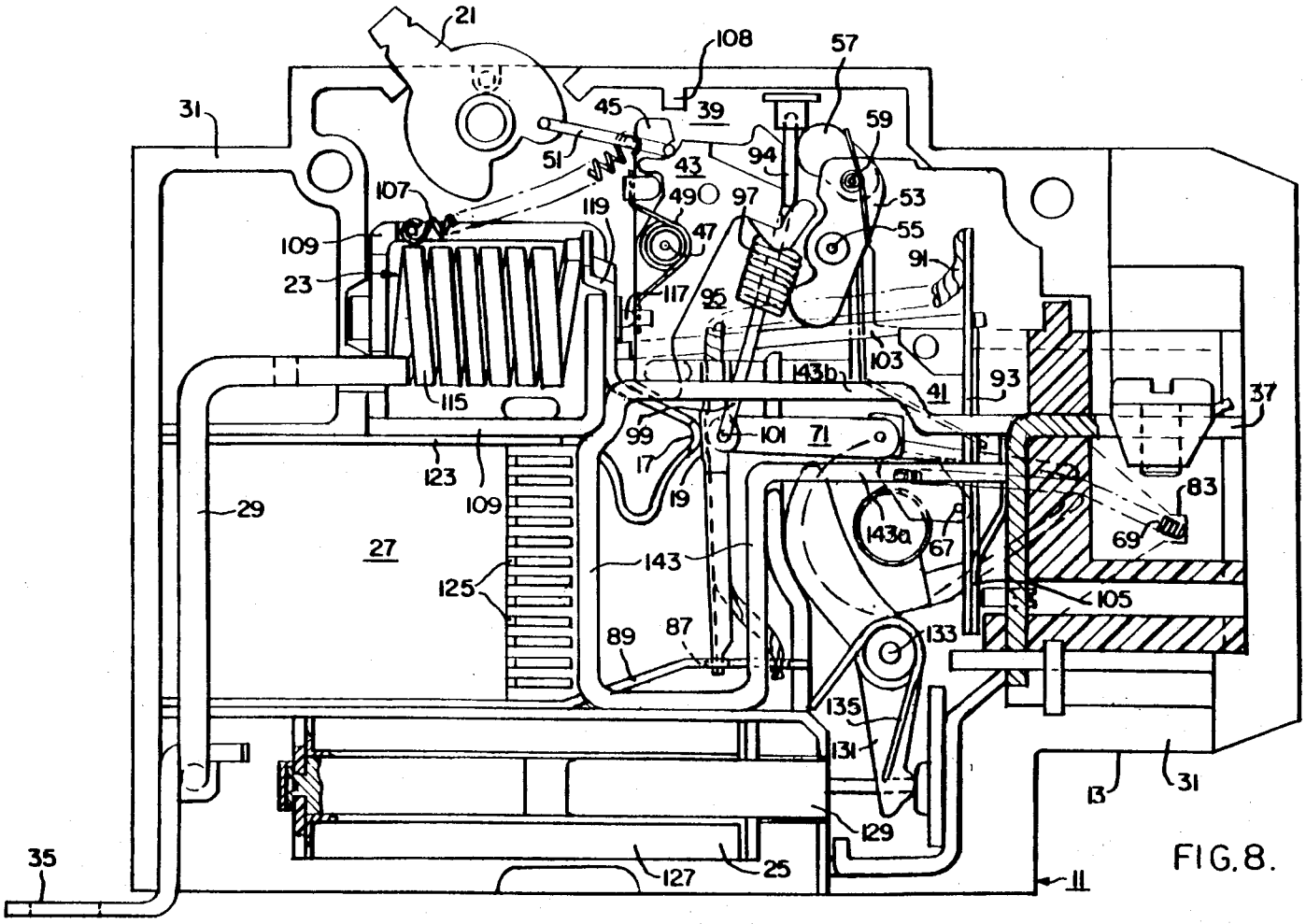
FIG. 8 is a vertical sectional view of another embodiment of the invention.

Another embodiment of the conductor or blowout coil of FIG. 1 is shown in FIG. 8, wherein a conductor or blowout coil 143 is disposed around the area of the contacts 17, 19 and the arc guide rails 89, 123. The conductor 143 includes the portion **143*a* which extends from the upper end of the conductor 105 forming a loop portion around the arcing area and including a conductor portion 143*b* extending to the load terminal 37. Thus, the loop portion of the conductor 143 applies the transverse magnetic field in the arcing area to use a force comprised of current density and the magnetic field to force the arc columns to move rapidly from the contacts to the arc quenching device 27**.

Figure 9:
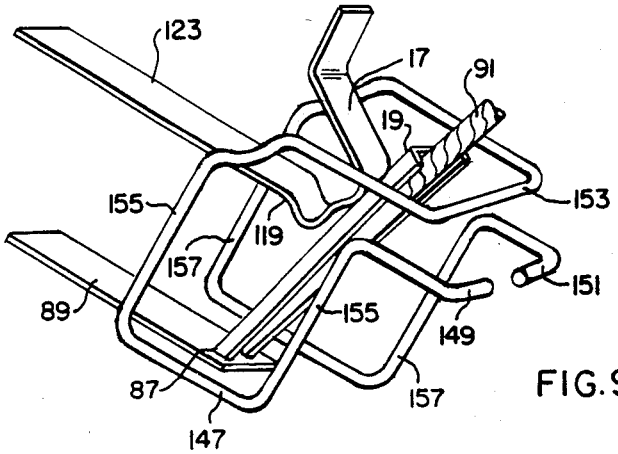
FIG. 9 is an isometric view of another embodiment of a pair of blowout coils connected in series for reverse current flow in the coils.

Another embodiment of the conductor or blowout coil 147 is shown in FIG. 9. The conductor 147 is a continuous member having opposite end portions 149 and 151 which are preferably connected to the conductor 105 (FIG. 8). The conductor 147 also includes a center portion 153 which is connected to the load terminal 145 in a suitable manner such as by welding. Between the ends and the center portion, the conductor includes a pair of loop sections 155, 157, which are disposed on opposite sides of the arcing area including the contacts 17, 19. Accordingly, as current enters the conductor 147 from the conductor 105, half of it moves through the loop 155 and the other half from the loop 157 from where it is conducted to the load terminal 145. As a result, each loop portion 155, 157 applies a transverse magnetic field in the arcing area which combines to move any arc column rapidly into the arc quenching device 27.

Figure 10:
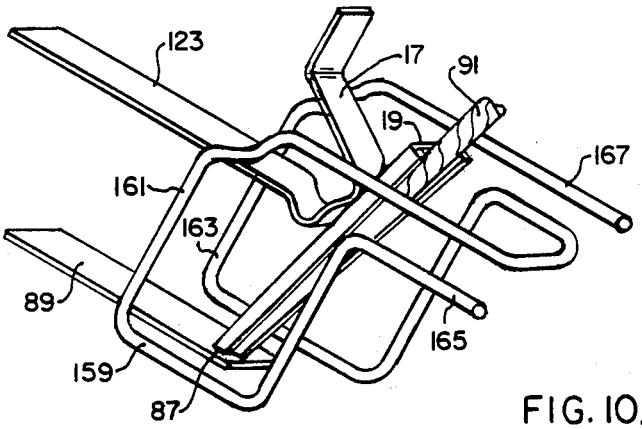
FIG. 10 is an isometric view of a pair of blowout coils connected in series for parallel current flow in the coils.

Still another embodiment of the invention is a conductor or blowout coil 159 shown in FIG. 10. The coil is comprised of a continuous wire-like member forming two loop sections 161, 163. The conductor includes two end portions 165, 167, the former of which is connected to the conductor 105 and the latter of which is connected to the load terminal 145, whereby the loop sections are disposed in series. Thus, the loops generate a transverse magnetic field in the arcing area by using the combined force of the current density and magnetic field on any arc column to move it rapidly into the arc quenching device 27.

In conclusion, the circuit breaker of this invention provides a current limiting solenoid operated means for energy management whereby a magnetic blowout coil provides a magnetic field across an arc or perpendicular thereto for removing an arc as soon as possible after separation of the contacts and stretching the arc as much as possible to increase voltage and thereby extinguish the arc existence.

What is claimed is:

1. A current limiting circuit breaker in an electric circuit comprising:

an electrically insulated housing including line and load terminals;

an arc quenching chamber within the housing and having a first arc guide rail along one side of the chamber and a second arc guide rail along the other side of the chamber, the arc guide rails being coextensive with the arc quenching chamber;

a circuit breaker structure within the housing and having stationary and movable contacts in an arcing zone in front of the chamber;

the stationary and the movable contacts being electrically connected to the first and second arc guide rails respectively and external of the arc quenching chamber;

means for actuating and movable contact between open and closed circuit positions; and a conductor connected in the circuit through the circuit breaker and including at least one loop conductor portion around and on one side of and adjacent to the areas of origin and of travel of an arc in the arcing zone so as to generate a magnetic field transverse to the opening contacts and to the arc guide rails and thence into the arc quenching chamber so as to enhance the magnetic driving force on an arc within the arc quenching chamber and thereby reduce the arcing time and augment current limiting effect; and the conductor comprises a first loop portion on one side of the arcing zone and a second loop portion on the other side and comprising an intermediate portion connecting the first and second loop portions in series so as to generate a pair of transverse magnetic fields mutually cooperative to move an arc from the contacts to the arc guide rails and into the arc quenching chamber.

2. The circuit breaker of claim 1 in which the conductor comprises a first loop portion on one side of the arcing zone and a second loop portion on the other side and comprising an intermediate portion connecting the first and second loop portions in parallel so as to generate a pair of transverse magnetic fields mutually cooperative to move an arc from the contacts to the arc guide rails and into the arc quenching chamber.

* * * * *